US010941471B2

(12) United States Patent
Kawamura et al.

(10) Patent No.: US 10,941,471 B2
(45) Date of Patent: Mar. 9, 2021

(54) HIGH-STRENGTH STEEL SHEET, HIGH-STRENGTH GALVANIZED STEEL SHEET, METHOD FOR MANUFACTURING HIGH-STRENGTH STEEL SHEET, AND METHOD FOR MANUFACTURING HIGH-STRENGTH GALVANIZED STEEL SHEET

(71) Applicant: JFE Steel Corporation, Tokyo (JP)

(72) Inventors: Kenji Kawamura, Tokyo (JP); Yoshihiko Ono, Tokyo (JP); Nobusuke Kariya, Tokyo (JP); Shinichi Furuya, Tokyo (JP); Kohei Hasegawa, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 382 days.

(21) Appl. No.: 16/065,867

(22) PCT Filed: Dec. 26, 2016

(86) PCT No.: PCT/JP2016/088682
§ 371 (c)(1),
(2) Date: Jun. 25, 2018

(87) PCT Pub. No.: WO2017/115748
PCT Pub. Date: Jul. 6, 2017

(65) Prior Publication Data

US 2019/0017156 A1 Jan. 17, 2019

(30) Foreign Application Priority Data

Dec. 28, 2015 (JP) ..... 2015-256214

(51) Int. Cl.

| | |
|---|---|
| ***C22C 38/60*** | (2006.01) |
| ***C21D 9/46*** | (2006.01) |
| ***C21C 7/10*** | (2006.01) |
| ***C22C 38/06*** | (2006.01) |
| ***C21D 8/02*** | (2006.01) |
| ***C22C 38/00*** | (2006.01) |
| ***C22C 38/02*** | (2006.01) |

(Continued)

(52) U.S. Cl.

CPC ..... *C22C 38/60* (2013.01); *B22D 11/00* (2013.01); *B22D 11/001* (2013.01); *B22D 11/113* (2013.01); *B22D 11/116* (2013.01); *C21C 7/10* (2013.01); *C21D 8/0205* (2013.01); *C21D 8/0226* (2013.01); *C21D 8/0236* (2013.01); *C21D 8/0273* (2013.01); *C21D 9/46* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/22* (2013.01); *C22C 38/26* (2013.01); *C22C 38/28* (2013.01); *C22C 38/32* (2013.01); *C22C 38/38* (2013.01); *C23C 2/02* (2013.01); *C23C 2/06* (2013.01); *C23C 2/28* (2013.01); *C23C 2/40* (2013.01); *C21D 2211/001* (2013.01); *C21D 2211/002* (2013.01); *C21D 2211/004* (2013.01); *C21D 2211/005* (2013.01); *C21D 2211/008* (2013.01)

(58) Field of Classification Search

CPC ..... B22D 11/113; B22D 11/116; C21C 7/10; C21D 2211/002; C21D 2211/004; C21D 2211/005; C21D 2211/008; C21D 8/0205; C21D 8/0226; C21D 8/0236

See application file for complete search history.

(56) References Cited

U.S. PATENT DOCUMENTS

| | | | |
|---|---|---|---|
| 9,650,690 | B2 | 5/2017 | Yamamoto et al. |
| 9,702,035 | B2 | 7/2017 | Kawata et al. |

(Continued)

FOREIGN PATENT DOCUMENTS

| | | | |
|---|---|---|---|
| CN | 101545074 | A | 9/2009 |
| CN | 101851732 | A | 10/2010 |

(Continued)

OTHER PUBLICATIONS

International Search Report and Written Opinion for International Application No. PCT/JP2016/088682, dated Apr. 4, 2017—5 pages.

(Continued)

*Primary Examiner* — Nicholas A Wang
(74) *Attorney, Agent, or Firm* — RatnerPrestia

(57) ABSTRACT

Provided are a high-strength steel sheet having a specified chemical composition, in which a Mn-segregation degree in a region within 100 μm from a surface thereof in a thickness direction is 1.5 or less, in a plane parallel to the surface of the steel sheet in a region within 100 μm from the surface of the steel sheet in the thickness direction, the number of oxide-based inclusion grains having a grain long diameter of 5 μm or more is 1000 or less/100 $mm^2$, a proportion of the number of oxide-based inclusion grains having a chemical composition containing alumina of 50 mass % or more, silica of 20 mass % or less, and calcia of 40 mass % or less to the total number of oxide-based inclusions having a grain long diameter of 5 μm or more is 80% or more, a specified metallographic structure, and a TS of 980 MPa or more, a high-strength galvanized steel sheet, and a manufacturing method thereof.

16 Claims, No Drawings

(51) Int. Cl.

| | |
|---|---|
| ***C22C 38/04*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| ***B22D 11/00*** | (2006.01) |
| ***B22D 11/116*** | (2006.01) |
| ***B22D 11/113*** | (2006.01) |
| ***C23C 2/28*** | (2006.01) |
| ***C23C 2/02*** | (2006.01) |
| ***C23C 2/06*** | (2006.01) |
| ***C23C 2/40*** | (2006.01) |

(56) References Cited

U.S. PATENT DOCUMENTS

| | | | |
|---|---|---|---|
| 2010/0247957 | A1 | 9/2010 | Hoshika et al. |
| 2015/0191808 | A1 | 7/2015 | Hashimura et al. |

FOREIGN PATENT DOCUMENTS

| | | | | |
|---|---|---|---|---|
| CN | 102719743 | | * | 10/2012 |
| CN | 103290317 | A | | 9/2013 |
| CN | 104583445 | A | | 4/2015 |
| EP | 2105515 | A2 | | 9/2009 |
| EP | 2762585 | A1 | | 8/2014 |
| EP | 2762589 | A1 | | 8/2014 |
| EP | 2891727 | A1 | | 7/2015 |
| EP | 3135785 | A1 | | 3/2017 |
| JP | 0899104 | A | | 4/1996 |
| JP | 2002363694 | A | | 12/2002 |
| JP | 2004300452 | A | | 10/2004 |
| JP | 2009066618 | A | | 4/2009 |
| JP | 2009202185 | A | | 9/2009 |
| JP | 2009215571 | A | | 9/2009 |
| JP | 2009299137 | A | | 12/2009 |
| JP | 2010189691 | A | | 9/2010 |
| JP | 2011111670 | A | | 6/2011 |
| JP | 2013221198 | A | | 10/2013 |
| JP | 2014051683 | | * | 3/2014 |
| JP | 2014051683 | A | | 3/2014 |
| JP | 2015151605 | A | | 8/2015 |
| KR | 20140054379 | A | | 5/2014 |
| WO | 2013047739 | A1 | | 4/2013 |
| WO | 2015162928 | A1 | | 10/2015 |
| WO | 2015198582 | A | | 12/2015 |

OTHER PUBLICATIONS

Chinese Office Action with Search Report for Chinese Application No. 201680076455.9, dated Jul. 22, 2019, 8 pages.

Extended European Search Report for European Application No. 16881723.7, dated Sep. 18, 2018—11 pages.

European Communication Pursuant to Article 94(3) for European Application No. 16881723.7, dated Jul. 1, 2019, 5 pages.

Korean Grant of Patent for Korean Application No. 10-2018-7017957, dated Jan. 16, 2020, with translation, 2 pages.

* cited by examiner

HIGH-STRENGTH STEEL SHEET, HIGH-STRENGTH GALVANIZED STEEL SHEET, METHOD FOR MANUFACTURING HIGH-STRENGTH STEEL SHEET, AND METHOD FOR MANUFACTURING HIGH-STRENGTH GALVANIZED STEEL SHEET

CROSS REFERENCE TO RELATED APPLICATIONS

This is the U.S. National Phase application of PCT/JP2016/088682, filed Dec. 26, 2016, which claims priority to Japanese Patent Application No. 2015-256214, filed Dec. 28, 2015, the disclosures of these applications being incorporated herein by reference in their entireties for all purposes.

TECHNICAL FIELD OF THE INVENTION

The present invention relates to a high-strength steel sheet and a high-strength galvanized steel sheet which can preferably be used as materials for, for example, automobile parts and which are excellent in terms of bendability and methods for manufacturing these steel sheets.

BACKGROUND OF THE INVENTION

Nowadays, there is a strong demand for improving fuel efficiency in order to decrease the amount of $CO_2$ emissions from automobiles in response to growing awareness of the need to conserve the global environment. Accordingly, there is an active tendency toward reducing the weight of automobile bodies by improving the strength of steel sheets, which are materials for automobile parts, in order to reduce the thickness of automobile parts. On the other hand, since a high-strength steel sheet is inferior to a soft steel sheet in terms of workability, it is difficult to perform forming work such as press forming on a high-strength steel sheet. In particular, since a steel sheet having a tensile strength of 980 MPa grade or more is subjected to form molding involving mainly a bending work mode in many cases, the kind of formability which is especially regarded as important is bending workability.

Various investigations have been conducted to date regarding a method for improving the bending workability of a high-strength steel sheet. For example, Patent Literature 1 discloses a technique in which bendability is improved by improving the inhomogeneity of a solidification microstructure in order to homogenize a hardness distribution in the surface layer of a steel sheet even though the microstructure includes ferrite and martensite. In addition, in the technique described in Patent Literature 1, by increasing the flow rate of molten steel at a solidification interface in the vicinity of the meniscus of a mold through the use of, for example, an electromagnetic stirring device in the mold in order to stir molten steel in the surface layer of a slab during a solidification process through the use of the molten steel flow, since inclusions and defects are less likely to be trapped between the arms of a dendrite, an inhomogeneous solidification microstructure is inhibited from growing in the vicinity of the surface layer of the slab when casting is performed, which results in a decrease in the inhomogeneity of a microstructure in the surface layer of a steel sheet due to such an inhomogeneous solidification microstructure and results in a decrease in the degree of a deterioration in bendability due to the inhomogeneity of a microstructure after cold rolling and annealing have been performed.

In addition, examples of a technique for improving the material properties of a steel sheet through the control of the amount and shape of inclusions include Patent Literature 2 and Patent Literature 3.

Patent Literature 2 discloses a high-strength cold-rolled steel sheet whose metallographic structure is specified along with the amount of inclusions in order to improve stretch flange formability. Patent Literature 2 proposes a high-strength cold-rolled steel sheet excellent in terms of stretch flange formability, the steel sheet having a microstructure including tempered martensite having a hardness of 380 Hv or less in an amount of 50% or more (including 100%) in terms of area ratio and the balance being ferrite, in which the number of cementite grains having a circle-equivalent grain diameter of 0.1 μm or more existing in the tempered martensite is 2.3 or less per 1 $\mu m^2$, and in which the number of inclusions having an aspect ratio of 2.0 or more existing in the whole microstructure is 200 or less per 1 $mm^2$.

In addition, Patent. Literature 3 proposes a high-strength steel sheet excellent in terms of stretch flange formability and fatigue resistance, the steel sheet having a chemical composition containing one or both of Ce and La in a total amount of 0.001% to 0.04%, in which, in terms of mass, the relationships (Ce+La)/acid-soluble Al≥0.1 and 0.4≤(Ce+La)/S≤50 are satisfied. Patent Literature 3 discloses the fact that, since MnS, TiS, and (Mn, Ti)S are precipitated on fine and hard Ce oxide, La oxide, cerium oxysulfide, and lanthanum oxysulfide, which are formed due to deoxidation occurring as a result of adding Ce and La, and since MnS, TiS, and (Mn, Ti)S which have been precipitated are less likely to deform even when rolling is performed, these MnS-based inclusions are less likely to become a starting point at which a crack occurs or a path through which a crack propagates when cyclic deformation or hole expansion work is performed due to a significant decrease in the amount of elongated MnS grains having a large grain size in the steel sheet. In addition, Patent Literature 3 discloses the fact that, by controlling the Ce concentration and La concentration in accordance with the acid-soluble Al concentration, $Al_2O_3$-based inclusions which are formed as a result of Al-deoxidation are not clustered so as to have a large grain size as a result of added Ce and La being subjected to reductive degradation so as to form inclusions having a small grain size.

CITATION LIST

Patent Literature

PTL 1: Japanese. Unexamined Patent Application Publication No. 2011-111670

PTL 2: Japanese Unexamined Patent Application Publication No. 2009-215571

PTL 3: Japanese Unexamined Patent Application Publication No. 2009-299137

SUMMARY OF THE INVENTION

However, in the case of the technique according to Patent Literature 1, since casting is performed under the condition that the flow rate of molten steel at a solidification interface in the vicinity of the meniscus of a mold is 15 cm/second or more, non-metal inclusions tend to be retained, which results in a problem in that it is not possible to inhibit bending cracking from occurring due to such inclusions. That is, there is a problem of unsatisfactory bending workability. Here, the term "the vicinity of the meniscus of a mold" denotes a portion so close to the meniscus of a mold that a dendrite structure is formed toward the center of a slab from the surface of the slab when molten steel is subjected to casting.

In addition, in the case of the technique according to Patent Literature 2, although stretch flange formability is improved by controlling the shape of, for example, MnS-based inclusions, there is no suggestion regarding the control of oxide-based inclusions, which have a large effect on bending workability. Therefore, it is difficult to say that the technique according to Patent Literature 2 sufficiently improves bending workability.

In addition, the technique according to Patent Literature 3 is not necessarily effective for improving bending workability. In addition, since adding special chemical elements such as Ce and La is necessary, there is a significant increase in manufacturing cost.

An object according to aspects of the present invention is, in view of the situation described above, to provide a high-strength steel sheet and a high-strength galvanized steel sheet having a tensile strength of 980 MPa or more and excellent bending workability and methods for manufacturing these steel sheets.

The present inventors, in order to solve the problems described above, conducted investigations regarding the controlling factors of the bending workability of a high-strength steel sheet and, as a result, found that a starting point at which cracking occurs when work is performed is an oxide-based inclusion grain which has a grain long diameter of 5 μm or more and which exists in a region within 100 μm from the surface of a steel sheet. In addition, it was clarified that it is effective to control the number of such inclusions to be 1000 or less for an observation area of 100 $mm^2$ (1 $cm^2$), that is, 10 pieces/$mm^2$ or less, in order to achieve excellent bending workability and that the propagation of a fine crack, which is formed when bending work is performed, is influenced by the chemical composition of steel, Mn-segregation degree in the surface layer of a steel sheet, that is, a region within 100 μm from the surface of the steel sheet, and the metallographic structure of the steel sheet, which is determined by heat treatment. Also, the ranges of the chemical composition (component composition) and metallographic structure of a steel sheet appropriate for manufacturing a high-strength steel sheet having a tensile strength of 980 MPa or more and excellent bending workability were found, resulting in the completion of the present invention.

Aspects of the present invention have been completed on the basis of the knowledge described above, and the subject matter of aspects of the present invention is as follows.

[1] A high-strength steel sheet having a chemical composition containing, by mass %, C: 0.07% to 0.30%, Si: 0.10% to 2.5%, Mn: 1.8% to 3.7%, P: 0.03% or less, S: 0.0020% or less, Sol. Al: 0.01% to 1.0%, N: 0.0006% to 0.0055%, O: 0.0008% to 0.0025%, and the balance being Fe and inevitable impurities, in which a Mn-segregation degree in a region within 100 μm from a surface of the steel sheet in a thickness direction is 1.5 or less, in a plane parallel to the surface of the steel sheet in a region within 100 μm from the surface of the steel sheet in the thickness direction, the number of oxide-based inclusion grains having a grain long diameter of 5 μm or more is 1000 or less per 100 $mm^2$, a proportion of the number of oxide-based inclusion grains having a chemical composition containing alumina in an amount of 50 mass % or more, silica in an amount of 20 mass % or less, and calcia in an amount of 40 mass % or less to the total number of oxide-based inclusion grains having a grain long diameter of 5 μm or more is 80% or more, a metallographic structure including, in terms of volume fraction, a martensite phase and a bainite phase in an amount of 25% to 100% in total, a ferrite phase in an amount of less than 75% (including 0%), and an austenite phase in an amount of less than 15% (including 0%), and a tensile strength of 980 MPa or more.

[2] The high-strength steel sheet according to item [1], in which Si (mass %)/Mn (mass %) is 0.20 or more and 1.00 or less in the chemical composition.

[3] The high-strength steel sheet according to item [1] or [2], in which the chemical composition further contains, by mass %, Ca: 0.0002% to 0.0030%.

[4] The high-strength steel sheet according to any one of items [1] to [3], in which the chemical composition further contains, by mass %, one, two, or more of Ti: 0.01% to 0.1%, Nb: 0.01% to 0.1%, V: 0.001% to 0.1%, and Zr: 0.001% to 0.1%.

[5] The high-strength steel sheet according to any one of items [1] to [4], in which the chemical composition further contains, by mass %, one, two, or all of Cr: 0.01% to 1.0%, Mo: 0.01% to 0.20%, and B: 0.0001% to 0.0030%.

[6] The high-strength steel sheet according to any one of items [1] to [5], in which the chemical composition further contains, by mass %, one, two, or all of Cu: 0.01% to 0.5%, Ni: 0.01% to 0.5%, and S: 0.001% to 0.1%.

[7] The high-strength steel sheet according to any one of items [1] to [6], in which the chemical composition further contains, by mass %, Sb: 0.005% to 0.05%.

[8] The high-strength steel sheet according to any one of items [1] to [7], in which the chemical composition further contains, by mass %, one or both of REM and Mg in an amount of 0.0002% or more and 0.01% or less in total.

[9] A high-strength galvanized steel sheet having the high-strength steel sheet according to any one of items [1] to [8] and a galvanizing layer formed on the surface of the high-strength steel sheet.

[10] A method for manufacturing the high-strength steel sheet according to any one of items [1] to [8], the method including performing refining in an RH vacuum degasser with a circulation time of 900 seconds or more, performing continuous casting on the refined molten steel under a condition that flow rate of the molten steel at a solidification interface in a vicinity of a meniscus of a mold is 1.2 m/min or less, heating the cast steel obtained through the casting directly or after having cooled the steel to a temperature of 1220° C. or higher and 1300° C. or lower, performing a first pass of rough rolling with a rolling reduction of 10% or more, performing a first pass of finish rolling with a rolling reduction of 20% or more, completing hot rolling at a finishing delivery temperature equal to or higher than the Ara transformation temperature, performing coiling at a temperature range of 400° C. or higher and lower than 550° C. to obtain a hot-rolled steel sheet, pickling the hot-rolled steel sheet, performing cold rolling on the pickled steel sheet with a rolling reduction ratio of 40% or more to obtain a cold-rolled steel sheet, heating the cold-rolled steel sheet at a heating temperature of 800° C. to 880° C., cooling the heated steel sheet to a rapid-cooling start temperature of 550° C. to 750° C., in which a retention time in a temperature range of 800° C. to 880° C. through the heating and cooling is 10 seconds or more, performing cooling at an average cooling rate of 15° C./sec or more from the rapid-cooling start temperature to a rapid-cooling stop temperature of 350° C. or lower, and holding the rapidly cooled steel sheet in a temperature range of 150° C. to 450° C. for a retention time of 100 seconds to 1000 seconds.

[11] A method for manufacturing a high-strength galvanized steel sheet, the method including forming a galvanizing layer on the surface of the high-strength steel sheet obtained by using the method according to item [10].

According to aspects of the present invention, it is possible to obtain a high-strength steel sheet and a high-strength galvanized steel sheet excellent in terms of bendability (bending workability) which can preferably be used as materials for automobile parts such as the structural member of an automobile by decreasing the number of inclusions in the surface layer of the steel sheet (a region within 100 μm from the surface of the steel sheet), by controlling the chemical composition of the inclusions to be within an appropriate range, and by decreasing the Mn-segregation degree of the surface layer of the steel sheet.

It is possible to expect an improvement in the collision safety of an automobile and an improvement in fuel efficiency due to a decrease in the weight of automobile parts by using the high-strength steel sheet or the high-strength galvanized steel sheet according to aspects of the present invention or manufactured by using the manufacturing method according to aspects of the present invention.

DETAILED DESCRIPTION OF EMBODIMENTS OF THE INVENTION

Hereafter, the embodiments of the present invention will be described. Here, the present invention is not limited to the embodiments below.

<High-Strength Steel Sheet>

First, the chemical composition of the high-strength steel sheet according to aspects of the present invention will be described.

The chemical composition of the high-strength steel sheet according to aspects of the present invention contains, by mass %, C: 0.07% to 0.30%, Si: 0.10% to 2.5%, Mn: 1.8% to 3.7%, P: 0.03% or less, S: 0.0020% or less, Sol. Al: 0.01% to 1.0%, N: 0.0006% to 0.0055%, O: 0.0008% to 0.0025%, and the balance being Fe and inevitable impurities.

In addition, the chemical composition may further contain, by mass %, Ca: 0.0002% to 0.0030%.

In addition, the chemical composition may further contain one, two, or more of Ti: 0.01% to 0.1%, Nb: 0.01% to 0.1%, V: 0.001% to 0.1%, and Zr: 0.001% to 0.1%.

In addition, the chemical composition may further contain, by mass %, one, two, or all of Cr: 0.01% to 1.0%, Mo: 0.01% to 0.20%, and B: 0.0001% to 0.0030%.

In addition, the chemical composition may further contain, by mass %, one, two, or all of Cu: 0.01% to 0.5%, Ni: 0.01% to 0.5%, and Sn: 0.001% to 0.1%.

In addition, the chemical composition may further contain, by mass %, Sb: 0.005% to 0.05%.

In addition, the chemical composition may further contain, by mass %, one or both of REM and Mg in an amount of 0.0002% or more and 0.01% or less in total.

Hereafter, each of the constituent chemical elements will be specifically described. Hereinafter, "%" used when describing the content of a constituent chemical element denotes "mass %".

C: 0.07% to 0.30%

C is a chemical element which is important for improving the strength of martensite in a quenched microstructure. The effect of improving strength is not sufficiently realized in the case where the C content is less than 0.07%. Therefore, the C content is set to be 0.07% or more, or preferably 0.09% or more. On the other hand, in the case where the C content is more than 0.30%, there is a significant deterioration in bending workability due to an excessive increase in strength, and fracturing occurs in a weld zone formed by performing spot welding when a cross tensile test is performed, which means that there is a significant deterioration in joint strength. Therefore, the C content is set to be 0.30% or less, or preferably 0.25% or less.

Si: 0.10% to 2.5%

Si is effective for improving the ductility of a high-strength steel sheet. In addition, since Si decreases the difference in hardness between a low-temperature-transformation phase and a ferrite phase by improving the strength of a ferrite phase through solid-solution strengthening, Si contributes to an improvement in bendability and stretch flange formability. Such effects are not sufficiently realized in the case where the Si content is less than 0.10%. Moreover, in the case where the Si content is less than 0.10%, the effect of improving bending workability through the control of the chemical composition of oxide-based inclusions, by which aspects of the present invention are characterized, is not realized. Therefore, the Si content is set to be 0.10% or more. On the other hand, in the case where the Si content is more than 2.5%, since a large amount of Si oxide is formed on the surface of a steel sheet in a hot rolling process, surface defects occur. Therefore, the Si content is set to be 2.5% or less.

Mn: 1.8% to 3.7%

Mn is added in order to improve the strength of a high-strength steel sheet. However, in the case where the Mn content is more than 3.7%, there is deterioration in manufacturability in cold rolling due to an increase in resistance to deformation when cold rolling is performed, and there are insufficient ductility and bendability due to an excessive increase in the hardness of a steel sheet. Moreover, there is an increase in the degree of the anisotropy of tensile properties due to the segregation of Mn, and there is deterioration in bendability due to the inhomogeneity of a metallographic structure in the thickness direction of a steel sheet. On the other hand, in the case where the Mn content is less than 1.8%, since there is an increase in the amount of ferrite formed when cooling for annealing is performed, and since the formation of pearlite tends to occur, there is insufficient strength. Therefore, the Mn content is set to be 1.8% to 3.7%. It is preferable that the lower limit of the Mn content be 2.0% or more. It is preferable that the upper limit of the Mn content be 3.5% or less.

Si (Mass %)/Mn (Mass %): 0.20 or More and 1.00 or Less

Although there is no particular limitation on Si/Mn-ratio, there may be a case of a significant deterioration in phosphatability in the case where the ratio is more than 1.00. On the other hand, in the case where the ratio is less than 0.20, since there is a decrease in the effect of solid-solution strengthening through the use of Si, there may be a case of an increase in bending-crack sensitivity due to the segregation of Mn. Therefore, it is preferable that Si/Mn ratio be 0.20 to 1.00. It is preferable that the lower limit of Si/Mn ratio be 0.25 or more. It is preferable that the upper limit of Si/Mn ratio be 0.70 or less.

P: 0.03% or Less

Since P is regarded as an impurity in the steel according to aspects of the present invention, and since P deteriorates spot weldability, it is preferable that P be removed as much as possible in a steel-making process. Here, there is a significant deterioration in spot weldability in the case where the P content is more than 0.03%. Therefore, it is necessary that the P content be 0.03% or less, preferably 0.02% or less, or more preferably 0.01% or less. It is preferable that the P content be 0.003% or more in order to save manufacturing costs.

S: 0.0020% or Less

Since S is regarded as an impurity in the steel according to aspects of the present invention, since S deteriorates spot weldability, and since S deteriorates bending workability by combining with Mn to form MnS having a large grain size, it is preferable that S be removed as much as possible in a steel-making process. Therefore, it is necessary that the S content be 0.0020% or less, or preferably 0.0010% or less. It is preferable that the S content be 0.0003% or more in order to save manufacturing costs.

Sol. Al: 0.01% to 1.0%

In the case where the Sol. Al content is less than 0.01%, the effects of deoxidation and denitrification are not sufficiently realized. Therefore, the Sol. Al content is set to be 0.01% or more, or preferably 0.03% or more. In addition, Sol. Al, which is, like Si, a ferrite-forming chemical element, is actively added in the case where a microstructure containing ferrite is intended. On the other hand, in the case where the Sol. Al content is more than 1.0%, it is difficult to stably achieve a tensile strength of 980 MPa or more. Therefore, the upper limit of the Sol. Al content is set to be 1.0%. Here, Sol. Al is acid-soluble aluminum, and the Sol. Al content is associated with the amount of all the Al in steel other than Al existing in the form of oxides.

N: 0.0006% to 0.0055%

Since N is an impurity contained in crude steel, and since N deteriorates the formability of a steel sheet, it is necessary that the N content be 0.0055% or less, or preferably 0.0045% or less. On the other hand, there is a significant increase in refining costs in order to control the N content to be less than 0.0006%. Therefore, the N content is set to be 0.0006% or more.

O: 0.0008% to 0.0025%

O is contained in, for example, metal oxides which are formed when refining is performed and retained in steel in the form of inclusions. In the case where the O content is more than 0.0025%, there is a significant deterioration in bending workability. Therefore, the O content is set to be 0.0025% or less, or preferably 0.0020% or less. On the other hand, there is a significant increase in refining costs in order to control the O content to be less than 0.0008%. In accordance with aspects of the present invention, as described below, it is possible to improve bending workability by appropriately control the chemical composition of oxide-based inclusions. Therefore, the O content is set to be 0.0008% or more in order to save refining costs.

In addition, in the case of the steel according to aspects of the present invention, the chemical elements described below may be added as needed in addition to the chemical elements described above.

Ca: 0.0002% to 0.0030%

Ca, which is an impurity contained in crude steel, combines with oxygen to form oxides and combined with other oxides to form complex oxides. In the case where such oxides exist in steel, defects occur in a steel sheet, and there is deterioration in bendability. Therefore, it is necessary that the Ca content be 0.0030% or less, or preferably 0.0010% or less. Here, in the case where steel of 980 MPa grade tensile strength is required to have strict bendability, it is more preferable that the Ca content be 0.0005% or less. Here, the term "strict bendability" denotes a case where the limit bending radius R/t, which is determined by using the method described in EXAMPLES, is 1.5 or less for 980 MPa grade (980 MPa to 1179 MPa), 2.5 or less for 1180 MPa grade (1180 MPa to 1319 MPa), and 3.0 or less for 1320 MPa grade or more (1320 MPa or more).

One, two, or more of Ti: 0.01% to 0.1%, Nb: 0.01% to 0.1%, V: 0.001% to 0.1%, and Zr: 0.001% to 0.1%

Ti, Nb, V, and Zr are effective for inhibiting a crack, which is generated by working, from propagating by inhibiting the crystal grain size from increasing as a result of forming carbides and nitrides in steel in a casting process and a hot rolling process. In order to realize such an effect, one, two, or more of these chemical elements may be added. However, in the case where the contents of these chemical elements are excessively large, since there is an increase in the amounts of carbonitrides precipitated, and since carbonitrides having a large grain size remain undissolved when a slab is heated, there is a deterioration in the formability of a product. Therefore, the Ti content is set to be 0.01% to 0.1%, the Nb content is set to be 0.01% to 0.1%, the V content is set to be 0.001% to 0.1%, and the Zr content is set to be 0.001% to 0.1%.

One, Two, or all of Cr: 0.01% to 1.0%, Mo: 0.01% to 0.20%, and B: 0.0001% to 0.0030%

Since Cr, Mo, and B are chemical elements which are effective for stabilizing the manufacturing conditions in a continuous annealing process, one, two, or all of these chemical elements may be added in order to realize such an effect. Since it is possible to realize such an effect in the case where the Cr content is 0.01% or more, the Mo content is 0.01% or more, or the B content is 0.0001% or more, the Cr content is set to be 0.01% or more, or preferably 0.1% or more, the Mo content is set to be 0.01% or more, or preferably 0.05% or more, and the B content is set to be 0.0001% or more, or preferably 0.0003% or more. On the other hand, in the case where the Cr content is more than 1.0%, the Mo content is more than 0.20%, or the B content is more than 0.0030%, there is deterioration in ductility. Therefore, the Cr content is set to be 1.0% or less, or preferably 0.7% or less, the Mo content is set to be 0.20% or less, or preferably 0.15% or less, and the B content is set to be 0.0030% or less, or preferably 0.0020% or less.

One, Two, or all of Cu: 0.01% to 0.5%, Ni: 0.01% to 0.5%, and Sn: 0.001% to 0.1%

Since Cu, Ni, and Sn are effective for improving the corrosion resistance of a steel sheet, one, two, or all of these chemical elements may be added in order to realize such an effect. Since it is possible to realize such an effect in the case where the Cu content is 0.01% or more, the Ni content is 0.01% or more, or the Sn content is 0.001% or more, the Cu content is set to be 0.01% or more, the Ni content is set to be 0.01% or more, and the Sn content is set to be 0.001% or more. On the other hand, in the case where the Cu content is more than 0.5%, the Ni content is more than 0.5%, or the Sn content is more than 0.1%, surface defects occur due to embrittlement occurring when casting or hot rolling is performed. Therefore, the Cu content is set to be 0.5% or less, the Ni content is set to be 0.5% or less, and the Sn content is set to be 0.1% or less.

Sb: 0.005% to 0.05%

Sb inhibits a decrease in the content of B existing in the surface layer of a steel sheet by being concentrated in the surface layer of the steel sheet in an annealing process of continuous annealing. The Sb content is set to be 0.005% or more in order to realize such an effect. On the other hand, in the case where the Sb content is more than 0.05%, such an effect becomes saturated, and there is deterioration in toughness due to the grain-boundary segregation of Sb. Therefore, the Sb content is set to be 0.005% to 0.05%. It is preferable that the lower limit of the Sb content be 0.008% or more. It is preferable that the upper limit of the Sb content be 0.02% or less.

One or Both of REM and Mg in an Amount of 0.0002% or More and 0.01% or Less in Total These chemical elements are effective for improving formability by decreasing the number of starting points at which fracturing occurs as a result of decreasing the grain size of inclusions. In the case where the total content of these chemical elements is less than 0.0002%, it is not possible to effectively realize the effect described above. On the other hand, in the case where the total content of these chemical elements is more than 0.01%, since there is conversely an increase in the grain size of inclusions, there is deterioration in formability. Here, the term "REM" denotes one of 17 chemical elements, that is, Sc, Y, and lanthanoid elements, and lanthanoid elements are added in the form of Mischmetall in an industrial use. In accordance with aspects of the present invention, the REM content means the total content of such chemical elements.

Here, in the case of the steel sheet according to aspects of the present invention, constituent chemical elements other than those described above are Fe and inevitable impurities. In the case where the chemical elements which may optionally be added as described above are contained in amounts less than the lower limits described above, since these chemical elements have no negative effect on the effects of aspects of the present invention, these chemical elements are regarded as inevitable impurities.

Hereafter, the reasons for the limitations on the Mn-segregation degree in the surface layer of the steel sheet according to aspects of the present invention will be described.

Mn-Segregation Degree in Region within 100 μm from Surface: 1.5 or Less

In accordance with aspects of the present invention, the term "Mn-segregation degree" denotes the ratio of the maximum Mn content in a region (surface layer) within 100 μm from the surface in the thickness direction of a steel sheet to the average Mn content of the steel sheet excluding the portion of central segregation of a steel sheet (Mn-segregation degree=(maximum Mn content/average Mn content)). In addition, in the case where Mn-segregation degree is determined, the Mn concentration distribution of the steel sheet is determined by using an EPMA (Electron Probe Micro Analyzer). At this time, since the determined value of Mn-segregation degree depends on the probe diameter of the EPMA, the segregation of Mn is appropriately evaluated by using a probe having a diameter of 2 μm. Here, since there is an increase in apparent maximum Mn-segregation degree in the case where inclusions such as MnS exist, evaluation is conducted with the value for inclusions being excluded in the case where inclusions are detected.

In the case where the Mn-segregation degree is more than 1.5, since the formation of a crack is promoted due to inhomogeneous metallographic structure when bending work is performed, there is a deterioration in bendability. Therefore, the Mn-segregation degree is set to be 1.5 or less, or preferably 1.3 or less.

Here, there is no particular limitation on the segregation of Mn existing in a region which is inside a region 100 μm from the surfaces of a steel sheet in the thickness direction in accordance with aspects of the present invention, because it has a small effect on bending workability.

Hereafter, the reasons for the limitations regarding oxide-based inclusions will be described.

In accordance with aspects of the present invention, in a region within 100 μm from the surface of a steel sheet in the thickness direction, the number of oxide-based inclusion grains having a grain long diameter of 5 μm or more is 1000 or less per 100 $mm^2$ and the proportion of the number of oxide-based inclusion grains having a chemical composition containing alumina in an amount of 50 mass % or more, silica in an amount of 20 mass % or less, and calcia in an amount of 40 mass % or less to the total number of the oxide-based inclusion grains described above is 80% or more.

Controlling the shape and chemical composition of oxide-based inclusions to be within the ranges described above is the most important requirement for improving bending workability, which is one of the objects according to aspects of the present invention. It is not necessary to control oxide-based inclusion grains existing in a region which is inside a region 100 μm from the surfaces of a steel sheet in the thickness direction or oxide-based inclusion grains having a grain long diameter of less than 5 μm in accordance with aspects of the present invention, because they have a small effect on bending workability. Therefore, limitations are put on oxide-based inclusions which exist in a region within 100 μm from the surface of a steel sheet in the thickness direction and which have a grain long diameter of 5 μm or more as described below. Here, the term "grain long diameter" denotes the length of a diameter defined as a circle-equivalent diameter.

In a plane parallel to the surface of a steel sheet in a region within 100 μm from the surface of a steel sheet in the thickness direction, in the case where the number of oxide-based inclusion grains having a grain long diameter of 5 μm or more is more than 1000 per 100 $mm^2$, there is a significant deterioration in bending workability. Therefore, the number of the inclusion grains described above is set to be 1000 or less per 100 $mm^2$. Here, since oxide-based inclusion grains are elongated by performing rolling, the size of inclusions is evaluated in a plane parallel to the surface of a steel sheet in accordance with aspects of the present invention. In addition, since the distribution of oxide-based inclusion grains having a grain long diameter of 5 μm or more in a region within 100 μm from the surface of a steel sheet in the depth direction (thickness direction) is usually almost homogeneous, the evaluation may be conducted in any cross section (plane parallel to the surface of a steel sheet) in a region within 100 μm from the surface of the steel sheet. However, in the case where the distribution in the thickness direction of the number of oxide-based inclusion grains having a grain long diameter of 5 μm or more is inhomogeneous, the evaluation should be conducted at the depth of the maximum number in the distribution. In addition, the evaluation should be conducted in a plane having an area of 100 $mm^2$ or more. Here, the term "inhomogeneous distribution" denotes a case where, when the number of oxide-based inclusion grains is determined at 9 positions at intervals of 10 μm in the depth direction from a position located 10 μm from the surface layer (surface), there is a number which is 30% more or less than the average number. In addition, the term "depth of the maximum number in the distribution" denotes a depth at which, when the number of oxide-based inclusion grains is determined at 9 positions at intervals of 10 μm in the depth direction from a position located 10 μm from the surface layer (surface), the maximum number is obtained.

Alumina, which is inevitably contained in oxide-based inclusion grains having a grain long diameter of 5 μm or more as a deoxidation product, has a small effect on bending workability in the form of a single substance of alumina. On the other hand, in the case where the alumina content in oxide-based inclusion grains is less than 50 mass %, since there is a decrease in the melting points of the oxides, the oxide-based inclusion grains are elongated when rolling work is performed so as to be likely to become starting points at which cracking occurs when bending work is performed. Therefore, the alumina content in oxide-based inclusion grains having a grain long diameter of 5 μm or more is set to be 50 mass % or more. When silica and calcia exist with alumina, since there is a decrease in the melting points of the oxides, the oxide-based inclusion grains are elongated when rolling work is performed so as to be likely to become starting points at which cracking occurs when bending work is performed, there is deterioration in the bending workability of a steel sheet. Since there is a significant deterioration in bending workability in the case where the silica content is more than 20 mass % or the calcia content is more than 40 mass %, the silica content is set to be 20 mass % or less, and the calcia content is set to be 40 mass % or less. Here, it is preferable that the chemical composition of inclusions contain alumina in an amount of 60 mass % or more, silica in an amount of 10 mass % or less, and calcia in an amount of 20 mass % or less in terms of average chemical composition of oxides in molten steel. At this time, as described above, in the case where, in a region within 100 μm from the surface of a steel sheet, the proportion of the number of oxide-based inclusion grains having a grain long diameter of 5 μm or more having a chemical composition satisfying the condition described above to the total number of oxide-based inclusion grains having a grain long diameter of 5 μm or more is 80% or more, it is possible to achieve good bending workability. Therefore, the proportion of the number of oxide-based inclusion grains having a chemical composition satisfying the condition described above is set to be 80% or more. That is, the proportion of the number of oxide-based inclusions having a chemical composition containing alumina in an amount of 50 mass % or more, silica in an amount of 20 mass % or less, and calcia in an amount of 40 mass % or less is set to be 80% or more. It is preferable that the proportion of the number be 88% or more, or more preferably 90% or more, in order to further improve bending workability. It is possible to control the chemical composition of oxides by controlling the chemical composition of slag in a converter or a secondary refining process. In addition, it is possible to quantitatively determine the average chemical composition of oxides in steel by taking a sample from a slab and by using an extraction-residue analysis method (refer to, for example, Kurayasu et al.: Tetsu-to-Hagané, vol. 82 (1996), p. 1017).

Hereafter, the reasons for the limitations on metallographic structure will be described.

Volume Fraction of Martensite Phase and Bainite Phase: 25% to 100%

By controlling the total volume fraction of a martensite phase and a bainite phase to be 25% or more, or preferably 40% or more, it is possible to easily achieve a tensile strength of 980 MPa or more. Although it is acceptable that the upper limit of the volume fraction be 100%, it is preferable that the total volume fraction of a martensite phase and a bainite phase be 95% or less, or more preferably 90% or less, in order to stably achieve satisfactory bending workability. Here, the meaning of the term "martensite phase" includes a tempered martensite phase in accordance with aspects of the present invention.

Volume Fraction of Ferrite Phase: Less than 75% (Including 0%)

Since a soft ferrite phase contributes to improving the elongation of a steel sheet, a ferrite phase may be included in an amount of less than 75% in accordance with aspects of the present invention. On the other hand, in the case where the volume fraction of a ferrite phase is more than 75%, there may be a case where it is difficult to achieve a tensile strength of 980 MPa, although it depends on the combination with low-temperature-transformation phases. Therefore, the volume fraction of a ferrite phase is set to be less than 75%, or preferably 60% or less.

Austenite Phase (Retained Austenite Phase): Less than 15%, (Including 0%)

Although it is preferable that an austenite phase not be included in the case where a ferrite phase is included in a microstructure, an austenite phase may be included in an amount of less than 15%, or preferably 3% or less, because this is practically harmless. Here, the term "case where a ferrite phase is included", in which it is preferable that an austenite phase not be included, denotes a case where a ferrite phase is included in an amount of 4% or more in terms of volume fraction. Although, it is acceptable that an austenite phase be included in an amount of less than 15% regardless of the amount of a ferrite phase, the preferable amount of an austenite depends on the amount of a ferrite phase. This is because, since an austenite phase transforms into a hard martensite phase when bending work is performed, while a large difference in hardness between a martensite phase and a soft ferrite phase causes bending cracking in the case where a soft ferrite phase exists, bending cracking is less likely to occur because of small difference in hardness between a martensite phase and an adjacent phase in the case where a ferrite phase is not included. That is, it is preferable that the volume fraction of an austenite phase be 0% to 5% in the case where the volume fraction of a ferrite phase is 4% or more, and it is preferable that the volume fraction of an austenite phase be less than 15% in the case where the volume fraction of a ferrite phase is less than 4%.

Other phases may be included within ranges in which the effects according to aspects of the present invention are not decreased. It is acceptable that the total volume fraction of other phases be 4% or less. Examples of other phases include pearlite.

Here, the high-strength steel sheet described above may have a galvanizing layer. Examples of a galvanizing layer include a hot-dip galvanizing layer and an electro-galvanizing layer. In addition, a hot-dip galvanizing layer may be a galvannealing layer, which is subjected to an alloying treatment.

Hereafter, the method for manufacturing the high-strength steel sheet according to aspects of the present invention will be described.

Circulation Time in RH Vacuum Degasser: 900 Seconds or More

A circulation time in an RH vacuum degasser after metals and ferroalloy for controlling a chemical composition have been finally added is set to be 900 seconds or more. Since there is deterioration in bendability in the case where Ca-based complex oxides exist in a steel sheet, it is necessary to decrease the amount of such oxides. Therefore, in a refining process, it is necessary that the circulation time in an RH vacuum degasser after metals and ferroalloy for controlling a chemical composition have been finally added be 900 seconds or more, or preferably 950 seconds or more. In addition, it is preferable that the circulation time described above be 1200 seconds or less in consideration of productivity.

Flow Rate of Molten Steel at Solidification Interface in the Vicinity of Meniscus of Mold: 1.2 m/Min or Less When continuous casting is performed after refining has been performed, by controlling the flow rate of molten steel at solidification interface in the vicinity of the meniscus of a mold to be 1.2 m/min or less, or preferably 1.0 m/min or less, non-metal inclusions are removed through floatation separation. On the other hand, in the case where the flow rate of molten steel is more than 1.2 m/min, since there is an increase in the amount of non-metal inclusions retained in steel, there is deterioration in bendability. Here, it is preferable that the flow rate of molten steel described above be 0.5 m/min or more in consideration of productivity.

In addition, in order to inhibit the segregation of Mn, soft reduction performed at the time of final solidification in continuous casting is also effective. The soft reduction is performed at the time of final solidification in order to resolve the problem associated with the mixture of solidified portions and non-solidified portions due to uneven cooling in casting, this results in a decrease in the degree of inhomogeneous solidification in the width direction of a cast plate and a decrease in the degree of segregation in the central portion in the thickness direction of the cast plate.

Slab Heating Temperature: 1220° C. or Higher and 1300° C. or Lower

The steel obtained by performing the casting described above is heated as needed (heating is not necessary in the case where the temperature of a slab after casting has been performed is 1220° C. or higher and 1300° C. or lower). In the case where heating is performed it is necessary that the slab heating temperature be 1220° C. or higher from the viewpoint of achieving a finishing delivery temperature equal to or higher than the Ar3 transformation temperature, from the viewpoint of a risk in that a decrease in slab heating temperature may results in difficulty in rolling due to an excessive increase in rolling load and shape defects of a base steel sheet after rolling has been performed, and from the viewpoint of a significant deterioration in the workability of a steel sheet in the case where undissolved Nb- or Ti-based precipitates having a large grain size exist. Since it is not preferable that the heating temperature be excessively high from an economical point of view, the upper limit of the slab heating temperature is set to be 1300° C.

Although there is no particular limitation on a slab heating time, there is a risk of deterioration in the workability of a steel sheet in the case where the heating time is short, because Nb- or Ti-based inclusions having a large grain size cannot be dissolved and are retained in the form of inclusions having a large grain size. Therefore, it is preferable that the slab heating time be 30 minutes or more, or more preferably one hour or more.

Rolling Reduction of First Pass of Rough Rolling: 10% or More

In the case where Mn-segregation degree is high in the surface layer of a steel sheet, since the formation of a crack is promoted due to inhomogeneous microstructure when bending work is performed, there is a deterioration in bendability. Thereby, it is possible to decrease Mn-segregation degree by controlling the rolling reduction of the first pass of rough rolling to be 10% or more, or preferably 12% or more. In the case where the rolling reduction is less than 10%, since there is a decrease in the effect of decreasing Mn-segregation degree, there is insufficient bendability. Here, it is preferable that the rolling reduction of the first pass be 18% or less, because an excessively large rolling reduction in the first pass may deteriorate the shape of a steel sheet.

Rolling Reduction of First Pass of Finish Rolling: 20% or More

In the case where Mn-segregation degree is high in the surface layer of a steel sheet, since the formation of a crack is promoted due to inhomogeneous Microstructure when bending work is performed, there is a deterioration in bendability. Thereby, it is possible to decrease Mn-segregation degree by controlling the rolling reduction of the first pass of finish rolling to be 20% or more, or preferably 24% or more. In the case where the rolling reduction is less than 20%, since there is a decrease in the effect of decreasing Mn-segregation degree, there is insufficient bendability. Here, it is preferable that the rolling reduction of the first pass be 35% or less from the viewpoint of sheet-transporting capability when hot rolling is performed.

Finishing Delivery Temperature of Hot Rolling: Equal to or Higher than $Ar_3$ Point ($Ar_3$ Transformation Temperature)

In the case where the finishing delivery temperature of hot rolling is lower than the $Ar_3$ point, a band-shaped microstructure composed of elongated grains is formed after hot finish rolling has been performed, and the band-shaped microstructure composed of elongated grains is retained even after cold rolling and annealing have been performed. Therefore, there is deterioration in bendability and stretch flange formability. Although there is no particular limitation on the upper limit of the finishing delivery temperature, in the case where the finishing delivery temperature is higher than 1000° C., since there is an excessive increase in the grain size of a microstructure after hot finish rolling has been performed, the microstructure having a large grain size is retained even after cold rolling and annealing have been performed. Therefore, the formation of a ferrite phase is delayed in a cooling process after cold rolling and annealing have been performed, which results in an excessive increase in hardness and a tendency for bendability and stretch flange formability to deteriorate. In addition, in this case, since a steel sheet is held at a high temperature after hot finish rolling has been performed so that thick scale is generated, there is an increase in the degree of surface asperity after pickling has been performed, which results in a negative effect on the bendability of a steel sheet after cold rolling and annealing have been performed. Here, the $Ar_3$ point is defined by the equation below.

$$Ar_3=910-310C-80Mn-20Cu-15Cr-55Ni-80Mo+0.35(t-8).$$

In the equation, an atomic symbol denotes the content (mass %) of the corresponding chemical element, and the content of a chemical element which is not added is assigned a value of 0. In addition, t denotes the thickness (mm) of a hot-rolled steel sheet.

Coiling Temperature: 400° C. or Higher and Lower than 550° C.

In the case where the coiling temperature is 550° C. or higher, there is an increase in the volume fraction of a ferrite phase in a microstructure after hot finish rolling has been performed, and a microstructure including a mixture of a ferrite phase and a pearlite phase is formed. Such a microstructure is an inhomogeneous microstructure including regions of a ferrite phase having a low C concentration and regions of pearlite phase having a high C concentration. In addition, since such an inhomogeneous microstructure is retained even after cold rolling and annealing have been performed in the case where a short-time heat treatment such as continuous annealing is performed, there is deterioration in both bendability and stretch flange formability of a steel sheet. On the other hand, in the case where the coiling temperature is excessively low, there is a disadvantage in terms of cost. In addition, since there is an excessive increase in the hardness of a steel sheet, there is an increase in resistance to deformation when cold rolling is performed, which results in deterioration in manufacturability in cold rolling. Therefore, the coiling temperature is set to be 400° C. or higher.

Cold Rolling Reduction Ratio: 40% or More.

In the case where the rolling reduction ratio is less than 40%, since homogeneous strain is not applied to a steel sheet, there is a variation in the degree of recrystallization in the steel sheet so that an inhomogeneous microstructure including grains having a large grain size and grains having a small grain size is formed, which results in a deterioration in bendability and stretch flange formability. In addition, since recrystallization and transformation are delayed in an annealing process following a cold rolling process, there is a decrease in the amount of an austenite phase in the annealing process, which results in an excessive increase in the amount of a ferrite phase in a finally obtained steel sheet. As a result, there is deterioration in the tensile strength of the steel sheet. Although there is no particular limitation on the upper limit of the rolling reduction ratio, in the case where the rolling reduction ratio is more than 70%, since recrystallization rapidly progresses, grain growth is promoted, which results in an excessive increase in crystal grain size. In addition, since the formation of a ferrite phase is inhibited in a cooling process, there is an excessive increase in hardness, which results in a deterioration in bendability and stretch flange formability. Therefore, it is preferable that the upper limit be 70% or less.

Heating Temperature (Annealing Temperature (Soaking Temperature)); 800° C. or Higher and 880° C. or Lower In the case where the annealing temperature is lower than 800° C., since there is an increase in ferrite phase fraction in heating and annealing processes, there is an excessive increase in the volume fraction of a ferrite phase which is finally obtained after annealing has been performed, which makes it difficult to achieve a tensile strength of 980 MPa or more. In addition, since there is a variation in the concentrations of added chemical elements such as C and Mn due to insufficient diffusion of such chemical elements, an inhomogeneous steel sheet microstructure (metallographic structure), in which low-temperature-transformation phases are inhomogeneously distributed, is formed, which results in a tendency for the workability (bendability, elongation, and stretch flange formability) of a steel sheet to deteriorate. On the other hand, In the case where the annealing temperature is higher than 880° C., since there is an excessive increase in austenite grain size in the case where heating is performed to a temperature range in which an austenite single phase is formed, there is a decrease in the amount of ferrite phase formed in a subsequent cooling process, which results in a deterioration in elongation. In addition, since there is an excessive increase in the crystal grain size of a ferrite phase and low-temperature-transformation phases, there is a deterioration in bendability and stretch flange formability. Therefore, the annealing temperature is set to be 800° C. or higher and 880° C. or lower, or preferably 820° C. or higher and 860° C. or lower.

Rapid-Cooling Start Temperature: 550° C. to 750° C.

After heating has been performed as described above, cooling is performed to a rapid-cooling start temperature of 550° C. to 750° C. In this process, by forming an appropriate amount of ferrite as needed, ductility is improved, and strength is controlled. Therefore, it is preferable that cooling to the rapid-cooling start temperature be slowly performed. By controlling the cooling rate (average cooling rate) in this process to be less than 15° C./sec, there is an improvement in the stability of the material properties of a product. Therefore, it is preferable that this cooling rate be less than 15° C./sec. In addition, in the case where the stop temperature of this cooling process, that is, the start temperature of rapid-cooling, which is performed following this cooling process, is lower than 550° C., since there is an excessive increase in the volume fraction of ferrite, there is a tendency for strength to be insufficient. Therefore, the rapid-cooling start temperature is set to be 550° C. or higher, or preferably 570° C. or higher. On the other hand, in the case where the rapid-cooling start temperature is higher than 750° C., there is deterioration in ductility, and there may be deterioration in the flatness of a steel sheet. Therefore, the rapid-cooling start temperature is set to be 750° C. or lower, or preferably 720° C. or lower.

Retention Time in Temperature Range of 800° C. or Higher and 880° C. or Lower: 10 Seconds or More In addition, the retention time in a temperature range of 800° C. or higher and 880° C. or lower through the heating and cooling processes described above is set to be 10 seconds or more. Hereinafter, the term "retention time" is also referred to as "soaking time". In the case where the soaking time is less than 10 seconds, since there is an insufficient amount of austenite formed, it is difficult to achieve sufficient strength. It is preferable that the soaking time be 30 seconds or more. Here, it is preferable that the soaking time be 1200 seconds or less in order to prevent deterioration in productivity. Here, in order to secure the retention time described above, the temperature may be held for a certain time period without immediately starting cooling after heating.

Average Cooling Rate from Rapid-Cooling Start Temperature to Rapid-Cooling Stop Temperature: 15° C./sec or More Rapid-Cooling Stop Temperature: 350° C. or Lower In the case where the cooling rate (average cooling rate) from the rapid-cooling start temperature to the rapid-cooling stop temperature described above is less than 15° C./sec, since quenching is not sufficiently performed, there is a tendency for strength to be insufficient. Therefore, the cooling rate from the rapid-cooling start temperature to the rapid-cooling stop temperature is set to be 15° C./sec or more. It is preferable that the cooling rate described above be 20° C./sec or more in order to achieve stable material properties of a product.

In addition, in the case where the rapid-cooling stop temperature is higher than 350° C., since there is an excessive increase in the amount of a bainite phase formed, or since there is an excessive increase in the amount of an austenite phase retained, there is insufficient strength and a deterioration in stretch flange formability. Therefore, the rapid-cooling stop temperature is set to be 350° C. or lower.

Retention (Holding) Time in Temperature Range of 150° C. to 450° C.: 100 Seconds to 1000 Seconds A steel sheet which has been subjected to rapid-cooling to the rapid-cooling stop temperature as described above is held at a temperature of 150° C. to 450° C. for 100 seconds to 1000 seconds immediately after having been cooled or after having been reheated. By holding the steel sheet at a temperature of 150° C. to 450° C. like this, since martensite, which has been formed when rapid-cooling is performed as described above, is tempered, there is an improvement in bending workability. In the case where the holding temperature after rapid-cooling has been performed is lower than 150° C., it is not possible to sufficiently realize such an effect. Therefore, the holding temperature after rapid-cooling has been performed is set to be 150° C. or higher. In addition, in the case where the holding temperature is higher than 450° C., since there is a significant deterioration in strength, it is difficult to achieve a tensile strength of 980 MPa or more. Therefore, the holding temperature after rapid-cooling has been performed is set to be 450° C. or lower. In addition, in the case where the holding time at a temperature of 150° C. to 450° C. after rapid-cooling has been performed is less than 100 seconds, it is not possible to sufficiently realize the above-described effect of improving bending workability as a result of martensite being tempered. Therefore, the holding time at a temperature of 150° C. to 450° C. is set to be 100 seconds or more. On the other hand, in the case where the holding time is more than 1000 seconds, since there is a significant deterioration in strength, it is difficult to achieve a tensile strength of 980 MPa or more. Therefore, the holding time at a temperature of 150° C. to 450° C. is set to be 1000 seconds or less.

Here, it is preferable to perform skin pass rolling after holding has been performed as described above. It is preferable to perform skin pass rolling with an elongation ratio of 0.1% to 0.7% in order to eliminate yield point elongation. In addition, the surface of the steel sheet according to aspects of the present invention may be, for example, subjected to electro-galvanizing or hot-dip galvanizing or coated with solid lubricant. In addition, an alloying treatment may be performed after hot-dip galvanizing has been performed.

EXAMPLES

By using steels having the chemical compositions given in Table 1, steel ingots were manufactured through melting and casting processes under the conditions given in Table 2. The obtained steel ingots (slabs having a thickness of 250 mm) were subjected to hot rolling under the conditions given in Table 2 to obtain hot-rolled steel sheets having a thickness of 2.6 mm. Subsequently, cold rolling was performed in order to obtain a thickness of 1.4 mm. Furthermore, a heat treatment simulating continuous annealing was performed.

This heat treatment simulating continuous annealing was performed under the conditions given in Table 2 (the cooling rate to the rapid-cooling stop temperature was 10° C./s). Subsequently, a tempering treatment was performed by reheating the steel sheets or by holding the steel sheets at the rapid-cooling stop temperature under the conditions given in Table 2, cooling was performed thereafter, and skin pass rolling was then performed with an elongation ratio of 0.2%.

TABLE 1 mass %

| Steel No. | C | Si | Mn | P | S | Sol. Al | N | O | Cr | V | Sb | Mo | Cu |
|---|---|---|---|---|---|---|---|---|---|---|---|---|---|
| 1 | 0.081 | 0.69 | 2.63 | 0.019 | 0.0011 | 0.037 | 0.0035 | 0.0011 | 0 | 0 | 0.012 | 0 | 0 |
| 2 | 0.094 | 0.54 | 2.69 | 0.018 | 0.0010 | 0.045 | 0.0038 | 0.0012 | 0 | 0 | 0.011 | 0 | 0 |
| 3 | 0.095 | 0.56 | 2.65 | 0.022 | 0.0016 | 0.058 | 0.0049 | 0.0009 | 0 | 0.06 | 0.015 | 0 | 0 |
| 4 | 0.083 | 0.63 | 2.52 | 0.024 | 0.0015 | 0.040 | 0.0041 | 0.0013 | 0.09 | 0 | 0 | 0.18 | 0 |
| 5 | 0.089 | 0.60 | 2.66 | 0.021 | 0.0017 | 0.022 | 0.0048 | 0.0012 | 0 | 0 | 0.014 | 0 | 0.07 |
| 6 | 0.125 | 0.53 | 2.52 | 0.014 | 0.0018 | 0.056 | 0.0035 | 0.0014 | 0 | 0 | 0.013 | 0 | 0 |
| 7 | 0.132 | 0.06 | 2.62 | 0.009 | 0.0014 | 0.033 | 0.0044 | 0.0015 | 0 | 0 | 0.006 | 0 | 0 |
| 8 | 0.200 | 0.65 | 2.45 | 0.012 | 0.0008 | 0.41 | 0.0041 | 0.0021 | 0 | 0 | 0 | 0 | 0 |
| 9 | 0.310 | 0.65 | 2.43 | 0.015 | 0.0006 | 0.031 | 0.0038 | 0.0016 | 0 | 0 | 0.014 | 0 | 0 |
| 10 | 0.132 | 0.72 | 2.26 | 0.016 | 0.0008 | 0.054 | 0.0027 | 0.0042 | 0 | 0 | 0.013 | 0 | 0 |
| 11 | 0.141 | 0.83 | 2.03 | 0.013 | 0.0010 | 0.020 | 0.0039 | 0.0016 | 0.35 | 0 | 0.012 | 0 | 0 |
| 12 | 0.195 | 0.74 | 2.51 | 0.014 | 0.0011 | 0.037 | 0.0034 | 0.0011 | 0 | 0 | 0.009 | 0 | 0 |
| 13 | 0.080 | 2.65 | 3.75 | 0.007 | 0.0021 | 0.028 | 0.0033 | 0.0008 | 0 | 0 | 0.011 | 0 | 0 |
| 14 | 0.051 | 1.60 | 1.42 | 0.019 | 0.0041 | 0.036 | 0.0044 | 0.0009 | 0 | 0 | 0.009 | 0 | 0 |
| 15 | 0.106 | 0.65 | 2.45 | 0.015 | 0.0010 | 0.035 | 0.0038 | 0.0015 | 0 | 0 | 0 | 0 | 0 |
| 16 | 0.125 | 0.25 | 2.82 | 0.014 | 0.0008 | 0.038 | 0.0041 | 0.0012 | 0 | 0 | 0 | 0 | 0 |
| 17 | 0.102 | 0.81 | 3.80 | 0.008 | 0.0005 | 0.035 | 0.0031 | 0.0015 | 0 | 0 | 0 | 0 | 0 |
| 18 | 0.103 | 0.64 | 2.64 | 0.007 | 0.0032 | 0.039 | 0.0035 | 0.0016 | 0 | 0 | 0 | 0 | 0 |
| 19 | 0.101 | 0.65 | 2.65 | 0.006 | 0.0005 | 0.045 | 0.0039 | 0.0022 | 0 | 0 | 0 | 0 | 0 |

| Steel No. | Ni | Sn | Ti | Nb | Zr | B | Ca | REM, Mg | Si/Mn | Note |
|---|---|---|---|---|---|---|---|---|---|---|
| 1 | 0 | 0 | 0.019 | 0.041 | 0 | 0.0015 | 0.0004 | 0 | 0.26 | Example |
| 2 | 0 | 0 | 0.018 | 0.044 | 0 | 0.0012 | 0.0005 | 0 | 0.20 | Example |
| 3 | 0 | 0 | 0.015 | 0.046 | 0 | 0.0028 | 0.0011 | 0 | 0.21 | Example |
| 4 | 0 | 0 | 0.016 | 0.032 | 0.005 | 0.0008 | 0.0013 | 0 | 0.25 | Example |
| 5 | 0.06 | 0 | 0.025 | 0.035 | 0 | 0.0011 | 0.0012 | 0.0005 | 0.23 | Example |
| 6 | 0 | 0.005 | 0.015 | 0.034 | 0 | 0.0011 | 0.0004 | 0 | 0.21 | Example |
| 7 | 0 | 0 | 0.016 | 0.035 | 0 | 0.0017 | 0.0003 | 0 | 0.02 | Comparative Example |
| 8 | 0 | 0 | 0 | 0 | 0 | 0 | 0.0005 | 0 | 0.27 | Example |
| 9 | 0 | 0 | 0 | 0.031 | 0 | 0.0012 | 0.0045 | 0 | 0.27 | Comparative Example |
| 10 | 0 | 0 | 0.015 | 0.024 | 0 | 0.0015 | 0.0041 | 0 | 0.32 | Comparative Example |
| 11 | 0 | 0 | 0.016 | 0.022 | 0 | 0.0012 | 0.0003 | 0 | 0.41 | Example |
| 12 | 0 | 0 | 0.021 | 0.023 | 0 | 0.0013 | 0.0021 | 0 | 0.29 | Example |
| 13 | 0 | 0 | 0.034 | 0.053 | 0 | 0.0012 | 0.0005 | 0 | 0.71 | Comparative Example |
| 14 | 0 | 0 | 0.020 | 0.032 | 0 | 0.0014 | 0.0004 | 0 | 1.13 | Comparative Example |
| 15 | 0 | 0 | 0 | 0 | 0 | 0 | <0.0002 | 0 | 0.27 | Example |

TABLE 1-continued

| | | | | | | | | | | |
|---|---|---|---|---|---|---|---|---|---|---|
| | | | | | | | | | | mass % |
| 16 | 0 | 0 | 0 | 0 | 0 | 0 | <0.0002 | 0 | 0.09 | Example |
| 17 | 0 | 0 | 0 | 0 | 0 | 0 | 0.0003 | 0 | 0.21 | Comparative Example |
| 18 | 0 | 0 | 0 | 0 | 0 | 0 | 0.0004 | 0 | 0.24 | Comparative Example |
| 19 | 0 | 0 | 0 | 0 | 0 | 0 | 0.0039 | 0 | 0.25 | Comparative Example |

*Underlined portions indicate values out of the range of the present invention.

TABLE 2

| | | | | Hot Rolling Condition | | | | | | Quenching & Tempering Treatment | | |
|---|---|---|---|---|---|---|---|---|---|---|---|---|
| Steel Sheet No. | Steel No. | Circulation Time (sec) | Molten Steel Flow Rate (m/min) | Heating Temperature (° C.) | Heating Time (min.) | First Rolling Reduction of Rough Rolling (%) | First Rolling Reduction of Finish Rolling (%) | Finishing Delivery Temperature (° C.) | Coiling Temperature (° C.) | Cold Rolling Reduction Ratio (%) | Soaking Temperature (° C.) | Soaking Time (s) |
| 1A | 1 | 1000 | 1.0 | 1250 | 180 | 15 | 25 | 880 | 520 | 50 | 830 | 100 |
| 1B | 1 | 600 | 1.0 | 1250 | 180 | 14 | 24 | 880 | 520 | 50 | 830 | 100 |
| 1C | 1 | 1000 | 1.7 | 1250 | 180 | 16 | 23 | 880 | 520 | 50 | 830 | 100 |
| 1D | 1 | 1000 | 1.0 | 1250 | 180 | 8 | 15 | 880 | 520 | 50 | 830 | 100 |
| 2A | 2 | 1000 | 1.0 | 1250 | 180 | 15 | 26 | 880 | 520 | 50 | 815 | 100 |
| 2B | 2 | 1150 | 1.0 | 1250 | 180 | 14 | 23 | 880 | 520 | 50 | 815 | 100 |
| 2C | 2 | 1000 | 1.0 | 1150 | 180 | 15 | 24 | 880 | 520 | 50 | 815 | 100 |
| 3A | 3 | 1000 | 1.0 | 1250 | 180 | 14 | 23 | 880 | 520 | 50 | 830 | 100 |
| 4A | 4 | 1000 | 1.0 | 1250 | 180 | 14 | 25 | 880 | 520 | 50 | 840 | 100 |
| 5A | 5 | 1000 | 1.0 | 1250 | 180 | 13 | 24 | 880 | 520 | 50 | 815 | 100 |
| 6A | 6 | 1000 | 1.0 | 1250 | 180 | 15 | 26 | 880 | 520 | 50 | 860 | 100 |
| 7A | 7 | 1000 | 1.0 | 1250 | 180 | 16 | 5 | 880 | 520 | 50 | 850 | 100 |
| 8A | 8 | 750 | 1.5 | 1250 | 180 | 16 | 24 | 880 | 520 | 50 | 810 | 300 |
| 8B | 8 | 1000 | 1.0 | 1250 | 180 | 16 | 25 | 880 | 520 | 50 | 810 | 300 |
| 9A | 9 | 1000 | 1.0 | 1250 | 180 | 15 | 26 | 880 | 520 | 50 | 830 | 300 |
| 10A | 10 | 1000 | 1.0 | 1250 | 180 | 17 | 25 | 880 | 520 | 50 | 860 | 300 |
| 11A | 11 | 1000 | 1.0 | 1250 | 180 | 15 | 25 | 880 | 520 | 50 | 860 | 300 |
| 12A | 12 | 1000 | 1.0 | 1250 | 180 | 13 | 25 | 880 | 520 | 50 | 860 | 300 |
| 12B | 12 | 1000 | 1.0 | 1250 | 180 | 16 | 23 | 880 | 520 | 50 | 860 | 250 |
| 13A | 13 | 1000 | 1.0 | 1180 | 10 | 14 | 27 | 880 | 520 | 50 | 830 | 300 |
| 14A | 14 | 1000 | 1.5 | 1250 | 180 | 15 | 23 | 880 | 520 | 50 | 830 | 300 |
| 15A | 15 | 1000 | 1.0 | 1250 | 180 | 15 | 25 | 860 | 500 | 50 | 830 | 100 |
| 16A | 16 | 1000 | 1.0 | 1250 | 180 | 15 | 25 | 860 | 500 | 50 | 830 | 100 |
| 17A | 17 | 1000 | 1.0 | 1250 | 180 | 15 | 25 | 860 | 500 | 50 | 830 | 100 |
| 18A | 18 | 1000 | 1.0 | 1250 | 180 | 15 | 26 | 860 | 500 | 50 | 830 | 100 |
| 19A | 19 | 1000 | 1.0 | 1250 | 180 | 14 | 24 | 860 | 500 | 50 | 830 | 100 |

| | Quenching & Tempering Treatment | | | | | |
|---|---|---|---|---|---|---|
| Steel Sheet No. | Rapid-cooling Start Temperature (° C.) | Average Cooling Rate to Rapid-cooling Stop Temperature (° C./s) | Rapid-cooling Stop Temperature (° C.) | Holding Temperature (° C.) | Holding Time (s) | Note |
| 1A | 710 | 18 | 340 | 300 | 470 | Example |
| 1B | 710 | 18 | 340 | 300 | 470 | Comparative Example |
| 1C | 710 | 18 | 340 | 300 | 470 | Comparative Example |
| 1D | 710 | 18 | 340 | 300 | 470 | Comparative Example |
| 2A | 700 | 24 | 260 | 260 | 490 | Example |
| 2B | 520 | 14 | 260 | 260 | 490 | Comparative Example |
| 2C | 650 | 20 | 300 | 260 | 490 | Comparative Example |
| 3A | 640 | 26 | 290 | 260 | 540 | Example |
| 4A | 700 | 17 | 340 | 350 | 730 | Example |
| 5A | 650 | 19 | 330 | 300 | 610 | Example |
| 6A | 670 | 15 | 340 | 380 | 490 | Example |
| 7A | 710 | 5 | 250 | 250 | 490 | Comparative Example |
| 8A | 700 | 650 | 25 | 350 | 600 | Comparative Example |
| 8B | 700 | 650 | 25 | 350 | 720 | Example |
| 9A | 700 | 650 | 25 | 300 | 600 | Comparative Example |
| 10A | 730 | 700 | 25 | 200 | 600 | Comparative Example |
| 11A | 730 | 700 | 25 | 250 | 500 | Example |

TABLE 2-continued

| | | | | | | |
|---|---|---|---|---|---|---|
| 12A | 730 | 700 | 25 | 300 | 500 | Example |
| 12B | 730 | 850 | 25 | 200 | 800 | Example |
| 13A | 700 | 650 | 25 | 250 | 720 | Comparative Example |
| 14A | 700 | 650 | 25 | 300 | 650 | Comparative Example |
| 15A | 700 | 19 | 340 | 300 | 440 | Example |
| 16A | 700 | 19 | 340 | 300 | 440 | Example |
| 17A | 700 | 700 | 25 | 300 | 800 | Comparative Example |
| 18A | 700 | 700 | 25 | 300 | 800 | Comparative Example |
| 19A | 700 | 18 | 340 | 340 | 450 | Comparative Example |

*Underlined portions indicate values out of the range of the present invention.

The steel sheets obtained as described above were subjected to investigations and evaluations regarding the Mn-segregation degree, oxide-based inclusions, metallographic structure (phase fraction (volume fraction)), tensile properties, and bending workability as described below.

Evaluation of Mn-Segregation Degree

Mn concentration distribution was determined in a region of 150 $mm^2$ located within 100 μm from the surface in the thickness direction by using an EPMA (Electron Probe Micro Analyzer). At this time, since the determined value of the Mn-segregation degree (the maximum Mn concentration in a region within 100 μm from the surface/the average Mn concentration in a region within 100 μm from the surface) depends on the probe diameter of the EPMA, the segregation, of Mn was evaluated by using a probe having a diameter of 2 μm. Here, since there is an increase in the apparent maximum Mn-segregation degree in the case where inclusions such as MnS exist, an evaluation was conducted with the value for inclusions being excluded in the case where inclusions were detected.

Evaluation of Oxide-Based Inclusions in Steel Sheet

The number of inclusion grains having a grain long diameter of 5 μm or more was investigated in a region of 10 mm×10 mm in planes parallel to the surface of the steel sheet at a depth of 50 μm and at a depth of 100 μm from the surface of the steel sheet in the thickness direction (since the results obtained at a depth of 50 μm and at a depth of 100 μm were the same (because of homogeneity), only one of the results is given in the Table). Here, it is needless to say that the plane parallel to the surface of the steel sheet was a plane including the rolling direction (a plane which includes the rolling direction and which is parallel to the surface of the steel sheet). In addition, regarding all the inclusion grains having a grain long diameter of 5 μm or more, the chemical composition thereof was quantitatively analyzed by performing SEM-EDX analysis to obtain the number of inclusion grains having a chemical composition containing alumina in an amount of 50 mass % or more, silica in an amount of 20 mass % or less, and calcia in an amount of 40 mass % or less (the number of grains having the appropriate chemical composition). In addition, the proportion of the number of grains having the appropriate chemical composition obtained as described above to the total number of inclusion grains having a grain long diameter of 5 μm or more ((number of grains having the appropriate chemical composition)/(total number of inclusion grains having a grain long diameter of 5 μm or more)) was calculated and defined as the proportion of grains having the appropriate chemical composition.

Metallographic Structure (Phase Fraction)

A plane located at ½ of the thickness in a cross section in the rolling direction was observed by using a scanning electron microscope (SEM). By performing observation 5 times (in 5 observation fields of view), by performing image analysis on cross-sectional microstructure photographs taken at a magnification of 2000 times to determine the occupation areas of each phase in a region of 50 μm square, and by calculating the average occupation area, the average occupation area was defined as the volume fraction of the phase. Here, the occupation area of the phases other than a ferrite phase and a pearlite phase was regarded as that of a martensite phase, a bainite phase, and a retained austenite phase. Subsequently, the amount of a retained austenite phase was determined by using an X-ray diffraction method with the Kα ray of Mo. That is, by using a test piece prepared so that the plane located at about ¼ of the thickness of the steel sheet was observed, and by calculating the volume fraction of a retained austenite phase from the peak intensities of the (211)-plane and (220)-plane of an austenite phase and the (200)-plane and (220)-plane of a ferrite phase, the volume fraction was defined as the volume fraction of a retained austenite phase. Subsequently, the difference calculated by subtracting the volume fraction of a retained austenite phase from the volume fraction corresponding to the occupation area which was regarded as that of a martensite phase, a bainite phase, and a retained austenite phase as described above was defined as the volume fraction of a martensite phase and a bainite phase.

Tensile Properties

By performing a tensile test in accordance with JIS Z 2241 on a JIS No. 5 test piece (JIS Z 2201) which had been taken so that the longitudinal direction thereof was a direction at a right angle to the rolling direction of the steel sheet, yield strength (YS), tensile strength (TS), and total elongation (El), which is the index of ductility, were determined. In addition, in the case of the example of, the present invention, a tensile strength of 980 MPa or more was achieved.

Bending Workability

By determining the limit bending radius (R (mm)) by performing a V block bend test (tip angle of the pressing tool: 90°, tip radius R: increased at intervals of 0.5 mm from 0.5 mm) in accordance with JIS Z 2248 on a JIS No. 3 test piece which had been taken from a position located at ½ of the width of the steel sheet so that the longitudinal direction thereof was the width direction of the coil, R/t was calculated by dividing the limit bending radius by the thickness (t (mm)) and used as an index. In addition, to evaluate variation in bendability in the width direction, the bending test was performed with the radius being equal to the limit bending radius R, which was used to calculate R/t described above, 5 times each at 7 positions located at ⅛ through ⅞ of the width. A case where the incidence ratio of cracking was 6% or less was judged as good. In the evaluation of bendability, by performing observation with a loupe at a magnification of 10 times, a case where a crack having a length of 0.2 mm or more was observed was judged as a case where cracking occurred.

The evaluation results are given in Table 3. As the results indicate, it is clarified that the examples of the present invention had a tensile strength. TS of 980 MPa or more, a limit bending radius R/t of 1.5 or less in the case of 980 MPa grade, 2.5 or less in the case of 1180 MPa grade, and 3.0 or less in the case of 1320 MPa grade or more, that is, excellent mechanical properties and bending workability. On the other hand, the comparative examples were poor in terms of at least one of such properties. In addition, the examples of the present invention had good stretch flange formability.

TABLE 3

| | | Observation Result of Oxide-based Inclusion | | | Microstructure | | | |
|---|---|---|---|---|---|---|---|---|
| Steel Sheet No. | Segregation Mn Segregation Degree | Piece/ $cm^2$ | Number of Grains Having Appropriate Chemical Composition | Proportion of Grains Having Appropriate Chemical Composition | Volume Fraction of Ferrite (%) | Volume Fraction of Austenite (%) | Volume Fraction of Bainite and Martensite (%) | Volume Fraction of Pearlite (%) |
| 1A | 1.2 | 710 | 670 | 0.94 | 39 | 0 | 61 | 0 |
| 1B | 1.3 | 1340 | 920 | 0.69 | 40 | 0 | 60 | 0 |
| 1C | 1.2 | 1510 | 1010 | 0.67 | 38 | 0 | 62 | 0 |
| 1D | 2.3 | 750 | 680 | 0.91 | 39 | 0 | 61 | 0 |
| 2A | 1.3 | 720 | 640 | 0.89 | 37 | 0 | 63 | 0 |
| 2B | 1.3 | 750 | 660 | 0.88 | 65 | 11 | 24 | 0 |
| 2C | 1.7 | 770 | 640 | 0.83 | 43 | 0 | 57 | 0 |
| 3A | 1.3 | 630 | 580 | 0.92 | 42 | 0 | 58 | 0 |
| 4A | 1.2 | 680 | 570 | 0.84 | 45 | 0 | 55 | 0 |
| 5A | 1.1 | 720 | 630 | 0.88 | 37 | 0 | 63 | 0 |
| 6A | 1.4 | 760 | 640 | 0.84 | 7 | 5 | 88 | 0 |
| 7A | 2.0 | 680 | 580 | 0.85 | 77 | 0 | 8 | 15 |
| 8A | 1.2 | 1450 | 980 | 0.68 | 42 | 0 | 58 | 0 |
| 8B | 1.3 | 820 | 690 | 0.84 | 9 | 0 | 91 | 0 |
| 9A | 1.2 | 680 | 560 | 0.82 | 0 | 0 | 100 | 0 |
| 10A | 1.3 | 400 | 350 | 0.88 | 5 | 0 | 95 | 0 |
| 11A | 1.3 | 470 | 410 | 0.87 | 37 | 0 | 63 | 0 |
| 12A | 1.4 | 650 | 590 | 0.91 | 12 | 0 | 88 | 0 |
| 12B | 1.3 | 600 | 520 | 0.87 | 0 | 0 | 100 | 0 |
| 13A | 1.7 | 630 | 550 | 0.87 | 35 | 0 | 65 | 0 |
| 14A | 1.2 | 1560 | 950 | 0.61 | 81 | 0 | 19 | 0 |
| 15A | 1.4 | 500 | 425 | 0.85 | 41 | 0 | 59 | 0 |
| 16A | 1.3 | 420 | 380 | 0.90 | 11 | 0 | 89 | 0 |
| 17A | 1.6 | 630 | 540 | 0.86 | 31 | 0 | 69 | 0 |
| 18A | 1.3 | 650 | 535 | 0.82 | 41 | 0 | 59 | 0 |
| 19A | 1.3 | 750 | 560 | 0.75 | 40 | 3 | 57 | 0 |

| | Property | | | | | | |
|---|---|---|---|---|---|---|---|
| Steel Sheet No. | Yield Strength (MPa) | Tensile Strength (MPa) | YR | Ductility (%) | R/t | Variation in Bendability (%) | Note |
| 1A | 785 | 1026 | 0.765 | 16.8 | 1.1 | 3 | Example |
| 1B | 781 | 1024 | 0.763 | 16.4 | 1.8 | 14 | Comparative Example |
| 1C | 779 | 1032 | 0.755 | 16.3 | 1.8 | 11 | Comparative Example |
| 1D | 783 | 1022 | 0.766 | 16.7 | 1.4 | 14 | Comparative Example |
| 2A | 865 | 1147 | 0.754 | 14.1 | 0.7 | 0 | Example |
| 2B | 623 | 824 | 0.756 | 22.1 | 0.4 | 0 | Comparative Example |
| 2C | 812 | 1045 | 0.777 | 15.0 | 1.8 | 11 | Comparative Example |
| 3A | 842 | 1132 | 0.744 | 12.0 | 1.1 | 3 | Example |
| 4A | 759 | 1095 | 0.693 | 12.4 | 0.7 | 0 | Example |
| 5A | 761 | 1096 | 0.694 | 12.6 | 0.7 | 3 | Example |
| 6A | 892 | 1253 | 0.712 | 11.5 | 1.8 | 3 | Example |
| 7A | 441 | 642 | 0.687 | 28.7 | <0.4 | 0 | Comparative Example |
| 8A | 872 | 1158 | 0.753 | 13.1 | 3.2 | 11 | Comparative Example |
| 8B | 901 | 1182 | 0.762 | 11.2 | 2.1 | 0 | Example |
| 9A | 1342 | 1750 | 0.767 | 6.4 | 4.3 | 3 | Comparative Example |
| 10A | 1035 | 1330 | 0.778 | 7.5 | 3.6 | 6 | Comparative Example |
| 11A | 724 | 1018 | 0.711 | 16.6 | 1.1 | 0 | Example |
| 12A | 967 | 1268 | 0.763 | 10.2 | 1.9 | 3 | Example |
| 12B | 1146 | 1390 | 0.824 | 8.7 | 2.7 | 5 | Example |
| 13A | 768 | 981 | 0.783 | 15.4 | 2.1 | 11 | Comparative Example |
| 14A | 574 | 724 | 0.793 | 31.2 | 0.4 | 14 | Comparative Example |
| 15A | 732 | 1051 | 0.696 | 15.8 | 1.1 | 3 | Example |
| 16A | 904 | 1242 | 0.728 | 11.3 | 1.8 | 0 | Example |
| 17A | 869 | 1231 | 0.706 | 12.4 | 3.3 | 5 | Comparative Example |
| 18A | 702 | 1035 | 0.678 | 15.1 | 2.2 | 15 | Comparative Example |
| 19A | 691 | 981 | 0.704 | 14.9 | 1.9 | 11 | Comparative Example |

*Underlined portions indicate values out of the range of the present invention.

The invention claimed is:

1. A high-strength steel sheet having a chemical composition containing, by mass %, C: 0.07% to 0.30%, Si: 0.10% to 2.5%, Mn: 1.8% to 3.7%, P: 0.03% or less, S: 0.0020% or less, Sol. Al: 0.01% to 1.0%, N: 0.0006% to 0.0055%, O: 0.0008% to 0.0025%, and the balance being Fe and inevitable impurities, wherein a Mn-segregation degree in a region within 100 μm from a surface of the steel sheet in a thickness direction is 1.5 or less, in a plane parallel to the surface of the steel sheet in a region within 100 μm from the surface of the steel sheet in the thickness direction, the number of oxide-based inclusion grains having a grain long diameter of 5 μm or more is 1000 or less per 100 $mm^2$, a proportion of the number of oxide-based inclusion grains having a chemical composition containing alumina in an amount of 50 mass % or more, silica in an amount of 20 mass % or less, and calcia in an amount of 40 mass % or less to the total number of oxide-based inclusion grains having a grain long diameter of 5 μm or more is 80% or more, a metallographic structure including, in terms of volume fraction, a martensite phase and a bainite phase in an amount of 25% to 100% in total, a ferrite phase in an amount of less than 75% (including 0%), and an austenite phase in an amount of less than 15% (including 0%), and a tensile strength of 980 MPa or more.

2. The high-strength steel sheet according to claim 1, wherein Si (mass %)/Mn (mass %) is 0.20 or more and 1.00 or less in the chemical composition.

3. The high-strength steel sheet according to claim 2, wherein the chemical composition further contains, at least any one group selected from the groups of:

Group I: by mass %, Ca: 0.0002% to 0.0030%,

Group II: by mass %, one, two, or more of

Ti: 0.01% to 0.1%;

Nb: 0.01% to 0.1%,

V: 0.001% to 0.1%, and

Zr: 0.001% to 0.1%,

Group III: by mass %, one, two, or all of

Cr: 0.01% to 1.0%,

Mo: 0.01% to 0.20%, and

B: 0.0001% to 0.0030%,

Group IV: by mass %, one, two, or all of

Cu: 0.01% to 0.5%,

Ni: 0.01% to 0.5%, and

Sn: 0.001% to 0.1%,

Group V: by mass %, Sb: 0.005% to 0.05%,and

Group VI: by mass %, one or both of REM and Mg in an amount of 0.0002% or more and 0.01% or less in total.

4. The high-strength steel sheet according to claim 1, wherein the chemical composition further contains, at least any one group selected from the groups of:

Group I: by mass %, Ca: 0.0002% to 0.0030%,

Group II: by mass %, one, two, or more of

Ti: 0.01% to 0.1%,

Nb: 0.01% to 0.1%,

V: 0.001% to 0.1%, and

Zr: 0.001% to 0.1%,

Group III: by mass %, one, two, or all of

Cr: 0.01% to 1.0%,

Mo: 0.01% to 0.20%, and

B: 0.0001% to 0.0030%,

Group IV: by mass %, one, two, or all of

Cu: 0.01% to 0.5%,

Ni: 0.01% to 0.5%, and

Sn: 0.001% to 0.1%,

Group V: by mass %, Sb: 0.005% to 0.05%, and Group VI: by mass %, one or both of REM and Mg in an amount of 0.0002% or more and 0.01% or less in total.

5. A high-strength galvanized steel sheet having the high-strength steel sheet according to claim 1 and a galvanizing layer formed on the surface of the high-strength steel sheet.

6. A high-strength galvanized steel sheet having the high-strength steel sheet according to claim 2 and a galvanizing layer formed on the surface of the high-strength steel sheet.

7. A high-strength galvanized steel sheet having the high-strength steel sheet according to claim 4 and a galvanizing layer formed on the surface of the high-strength steel sheet.

8. A high-strength galvanized steel sheet having the high-strength steel sheet according to claim 3 and a galvanizing layer formed on the surface of the high-strength steel sheet.

9. A method for manufacturing the high-strength steel sheet according to claim 1, the method comprising performing refining in an RH vacuum degasser with a circulation time of 900 seconds or more, performing continuous casting on the refined molten steel under a condition that a flow rate of the molten steel at a solidification interface in a vicinity of a meniscus of a mold is 1.2 m/min or less, heating the cast steel obtained through the casting directly or after having cooled the steel to a temperature of 1220° C. or higher and 1300° C. or lower, performing a first pass of rough rolling with a rolling reduction of 10% or more, performing a first pass of finish rolling with a rolling reduction of 20% or more, completing hot rolling at a finishing delivery temperature equal to or higher than the $Ar_3$ transformation temperature, performing coiling at a temperature range of 400° C. or higher and lower than 550° C. to obtain a hot-rolled steel sheet, pickling the hot-rolled steel sheet, performing cold rolling on the pickled steel sheet with a rolling reduction ratio of 40% or more to obtain a cold-rolled steel sheet, heating the cold-rolled steel sheet at a heating temperature of 800° C. to 880° C., cooling the heated steel sheet to a rapid-cooling start temperature of 550° C. to 750° C., in which a retention time in a temperature range of 800° C. to 880° C. through the heating and cooling is 10 seconds or more, performing cooling at an average cooling rate of 15° C./sec or more from the rapid-cooling start temperature to a rapid-cooling stop temperature of 350° C. or lower, and holding the rapidly cooled steel sheet in a temperature range of 150° C. to 450° C. for a retention time of 100 seconds to 1000 seconds.

10. A method for manufacturing the high-strength steel sheet according to claim 2, the method comprising performing refining in an RH vacuum degasser with a circulation time of 900 seconds or more, performing continuous casting on the refined molten steel under a condition that a flow rate of the molten steel at a solidification interface in a vicinity of a meniscus of a mold is 1.2 m/min or less, heating the cast steel obtained through the casting directly or after having cooled the steel to a temperature of 1220° C. or higher and 1300° C. or lower, performing a first pass of rough rolling with a rolling reduction of 10% or more, performing a first pass of finish rolling with a rolling reduction of 20% or more, completing hot rolling at a finishing delivery temperature equal to or higher than the $Ar_3$ transformation temperature, performing coiling at a temperature range of 400° C. or higher and lower than 550° C. to obtain a hot-rolled steel sheet, pickling the hot-rolled steel sheet, performing cold rolling on the pickled steel sheet with a rolling reduction ratio of 40% or more to obtain a cold-rolled steel sheet, heating the cold-rolled steel sheet at a heating temperature of 800° C. to 880° C., cooling the heated steel sheet to a rapid-cooling start temperature of 550° C. to 750° C., in which a retention time in a temperature range of 800° C. to 880° C. through the heating and cooling is 10 seconds or more, performing cooling at an average cooling rate of 15° C./sec or more from the rapid-cooling start temperature to a rapid-cooling stop temperature of 350° C. or lower, and holding the rapidly cooled steel sheet in a temperature range of 150° C. to 450° C. for a retention time of 100 seconds to 1000 seconds.

11. A method for manufacturing the high-strength steel sheet according to claim 4, the method comprising performing refining in an RH vacuum degasser with a circulation time of 900 seconds or more, performing continuous casting on the refined molten steel under a condition that a flow rate of the molten steel at a solidification interface in a vicinity of a meniscus of a mold is 1.2 m/min or less, heating the cast steel obtained through the casting directly or after having cooled the steel to a temperature of 1220° C. or higher and 1300° C. or lower, performing a first pass of rough rolling with a rolling reduction of 10% or more, performing a first pass of finish rolling with a rolling reduction of 20% or more, completing hot rolling at a finishing delivery temperature equal to or higher than the $Ar_3$ transformation temperature, performing coiling at a temperature range of 400° C. or higher and lower than 550° C. to obtain a hot-rolled steel sheet, pickling the hot-rolled steel sheet, performing cold rolling on the pickled steel sheet with a rolling reduction ratio of 40% or more to obtain a cold-rolled steel sheet, heating the cold-rolled steel sheet at a heating temperature of 800° C. to 880° C., cooling the heated steel sheet to a rapid-cooling start temperature of 550° C. to 750° C., in which a retention time in a temperature range of 800° C. to 880° C. through the heating and cooling is 10 seconds or more, performing cooling at an average cooling rate of 15° C./sec or more from the rapid-cooling start temperature to a rapid-cooling stop temperature of 350° C. or lower, and holding the rapidly cooled steel sheet in a temperature range of 150° C. to 450° C. for a retention time of 100 seconds to 1000 seconds.

12. A method for manufacturing the high-strength steel sheet according to claim 3, the method comprising performing refining in an RH vacuum degasser with a circulation time of 900 seconds or more, performing continuous casting on the refined molten steel under a condition that a flow rate of the molten steel at a solidification interface in a vicinity of a meniscus of a mold is 1.2 m/min or less, heating the cast steel obtained through the casting directly or after having cooled the steel to a temperature of 1220° C. or higher and 1300° C. or lower, performing a first pass of rough rolling with a rolling reduction of 10% or more, performing a first pass of finish rolling with a rolling reduction of 20% or more, completing hot rolling at a finishing delivery temperature equal to or higher than the $Ar_3$ transformation temperature, performing coiling at a temperature range of 400° C. or higher and lower than 550° C. to obtain a hot-rolled steel sheet, pickling the hot-rolled steel sheet, performing cold rolling on the pickled steel sheet with a rolling reduction ratio of 40% or more to obtain a cold-rolled steel sheet, heating the cold-rolled steel sheet at a heating temperature of 800° C. to 880° C., cooling the heated steel sheet to a rapid-cooling start temperature of 550° C. to 750° C., in which a retention time in a temperature range of 800° C. to 880° C. through the heating and cooling is 10 seconds or more, performing cooling at an average cooling rate of 15° C./sec or more from the rapid-cooling start temperature to a rapid-cooling stop temperature of 350° C. or lower, and holding the rapidly cooled steel sheet in a temperature range of 150° C. to 450° C. for a retention time of 100 seconds to 1000 seconds.

13. A method for manufacturing a high-strength galvanized steel sheet, the method comprising forming a galvanizing layer on the surface of the high-strength steel sheet obtained by using the method according to claim 9.

14. A method for manufacturing a high-strength galvanized steel sheet, the method comprising forming a galvanizing layer on the surface of the high-strength steel sheet obtained by using the method according to claim 10.

15. A method for manufacturing a high-strength galvanized steel sheet, the method comprising forming a galvanizing layer on the surface of the high-strength steel sheet obtained by using the method according to claim 11.

16. A method for manufacturing a high-strength galvanized steel sheet, the method comprising forming a galvanizing layer on the surface of the high-strength steel sheet obtained by using the method according to claim 12.

* * * * *